US011992880B1

(12) United States Patent
Imbrogno

(10) Patent No.: US 11,992,880 B1
(45) Date of Patent: May 28, 2024

(54) ACOUSTICAL DAMPENING POWDER METAL PARTS

(71) Applicant: Peter G. Imbrogno, Dubois, PA (US)

(72) Inventor: Peter G. Imbrogno, Dubois, PA (US)

(73) Assignee: Keystone Powdered Metal Company, St, Marys, PA (US)

( * ) Notice: Subject to any disclaimer, the term of this patent is extended or adjusted under 35 U.S.C. 154(b) by 7 days.

(21) Appl. No.: 16/934,580

(22) Filed: Jul. 21, 2020

Related U.S. Application Data

(60) Provisional application No. 62/877,043, filed on Jul. 22, 2019.

(51) Int. Cl.
*B22F 7/00* (2006.01)
*B22F 5/08* (2006.01)

(52) U.S. Cl.
CPC ..... *B22F 7/008* (2013.01); *B22F 5/08* (2013.01); *B22F 2302/40* (2013.01); *B22F 2304/10* (2013.01)

(58) Field of Classification Search
CPC ..... B22F 7/008; B22F 5/08; B22F 2302/40; B22F 2304/10
See application file for complete search history.

(56) References Cited

U.S. PATENT DOCUMENTS 3,889,350 A * 6/1975 Mocarski ..... C22C 33/02 419/48
5,080,963 A * 1/1992 Tatarchuk ..... H01G 11/26 428/605
5,507,257 A * 4/1996 Sakai ..... C22C 33/0257 123/188.9
6,632,263 B1 * 10/2003 Nigarura ..... C22C 38/16 419/48
6,705,848 B2 3/2004 Scancarello
(Continued)

FOREIGN PATENT DOCUMENTS

CN 1131069 A * 9/1996
WO WO-2018163568 A1 * 9/2018 ..... B22F 3/162

OTHER PUBLICATIONS

Ernie Wheeler,Cost Reduction Using Powder Metal for Pump and Metering Gears, Gear Solutions, https://gearsolutions.com/features/cost-reduction-using-powder-metal-for-pump-and-metering-gears/, 2013 (Year: 2013).*

(Continued)

*Primary Examiner* — Adil A. Siddiqui
(74) *Attorney, Agent, or Firm* — Alvin T. Rockhill

(57) ABSTRACT

It has been unexpected found that the sound dampening characteristics of powder metal parts can be dramatically improved by incorporating coarse graphite into the part. This is beneficial in applications where parts to generate noise during operation, such as in gears, rotors and sprockets. Surprisingly, the incorporation of the coarse graphite into such parts does not significantly compromise the strength, durability, wear characteristics, or service life of the part. Such parts can also be manufactured to a high level of tolerance and with good uniformity. Such parts are comprised of a sintered powder metal composition which includes 0.1 weight percent to 5 weight percent of a coarse graphite having a particle size wherein at least at least 30 percent of the coarse graphite will not pass through a 325 mesh screen.

19 Claims, 1 Drawing Sheet

(56) References Cited

U.S. PATENT DOCUMENTS 6,890,368 B2 * 5/2005 Braillard ..... F16N 15/00 419/36
7,364,803 B1 * 4/2008 Anderson ..... B23P 15/14 419/48
7,794,551 B1 * 9/2010 Imbrogno ..... B22F 3/1007 148/209
7,854,995 B1 12/2010 Anderson
11,097,346 B1 * 8/2021 Anderson ..... F16H 55/17
2003/0138339 A1 * 7/2003 Scancarello ..... B22F 5/00 418/55.2
2004/0144203 A1 * 7/2004 Unami ..... B22F 1/105 75/243
2004/0175286 A1 * 9/2004 Hammond ..... C04B 35/632 419/37
2004/0221682 A1 * 11/2004 Gwozdz ..... C04B 35/62823 419/36
2011/0091344 A1 * 4/2011 Christopherson, Jr. ..... C22C 33/0221 75/243
2011/0212339 A1 * 9/2011 Binder ..... B22F 5/006 419/10
2016/0244859 A1 * 8/2016 Beaudoin ..... C21B 13/0086
2017/0045136 A1 * 2/2017 Taga ..... B30B 15/022
2017/0266723 A1 * 9/2017 Sato ..... B22F 1/10
2018/0072575 A1 * 3/2018 Gulas ..... C09C 1/56
2019/0224752 A1 * 7/2019 Sonoda ..... B22F 3/162
2020/0180032 A1 * 6/2020 Ishii ..... F16C 33/104
2021/0078108 A1 * 3/2021 Drier ..... B33Y 40/10
2021/0354199 A1 * 11/2021 Anderson ..... C22C 38/12

OTHER PUBLICATIONS

Graphite Grades—Properties of Graphite Materials, SEMCO Carbon, https://www.semcocarbon.com/blog/graphite-grades (https://web.archive.org/web/20200814015954/https://www.semcocarbon.com/blog/graphite-grades), accessed from 2020 (Year: 2022).*
Canada Carbon—B.E.T. Surface Area and Porosity, Canada Carbon, https://www.canadacarbon.com/surface-area-porosity(https://web.archive.org/web/20140905081642/https://www.canadacarbon.com/surface-area-porosity) accessed from 2014 (Year: 2022).*
Spherical Graphite Powder Products_HPMS Graphite, https://hpmsgraphite.com/sphericalgraphite, 2022 (Year: 2022).*
Bulk density, Wikipedia, https://en.wikipedia.org/wiki/Bulk_density, 2022 (Year: 2022).*
CN1131069A: Espacenet English Machine translation (Year: 1996).*

* cited by examiner

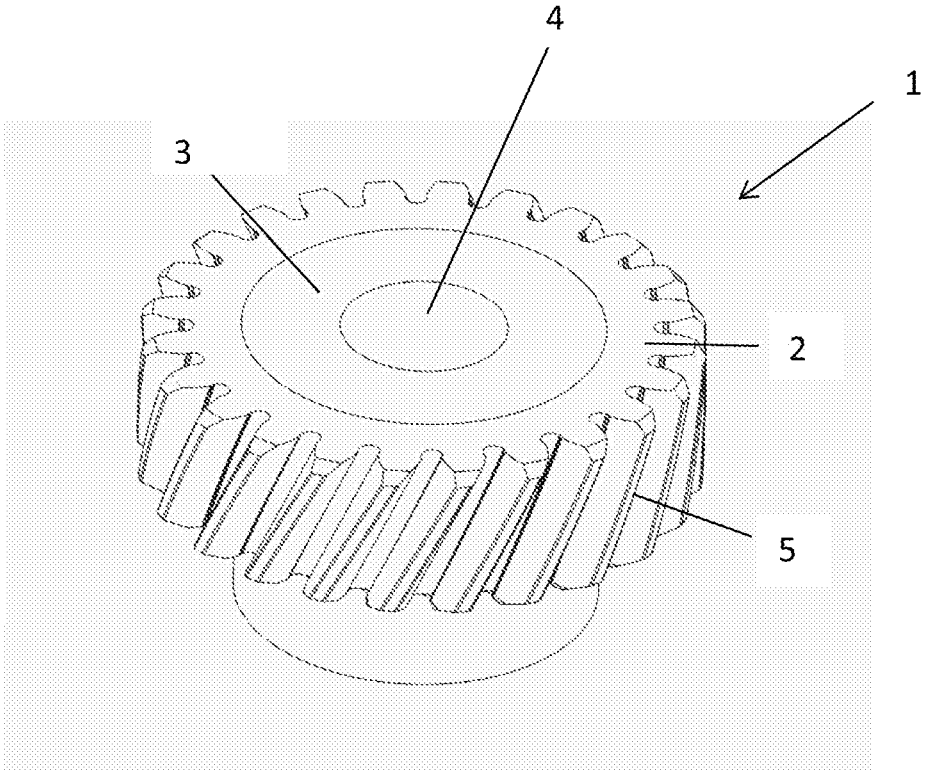
4
1
3
2
5

ACOUSTICAL DAMPENING POWDER METAL PARTS

This application claims the benefit of U.S. Provisional Patent Application Ser. No. 62/877,043, filed on Jul. 22, 2019. The teachings of U.S. Provisional Patent Application Ser. No. 62/877,043 are incorporated by reference herein in their entirety.

FIELD OF THE INVENTION

This invention relates to powder metal parts which have excellent acoustical dampening characteristics. Such parts are of particular value in applications where it is desirable to reduce the level of noise generated by the part under normal operating conditions, such as is generally the case with gears, rotors, and sprockets.

BACKGROUND OF THE INVENTION

Powder metal technology can be utilized in manufacturing parts having intricate designs that frequently cannot be made by casting, forging or machining. In such applications, powder metal parts can typically be made at high volume levels at a reduced cost as compared to parts of similar design wherein machining is required. Accordingly, for economic and practical reasons, powdered metal parts are commonly used in manufacturing a wide variety of parts for use in countless applications. In cases where a given part is being manufactured in high volumes the advantage of using powder metal technology is even more pronounced by virtue of reducing labor costs.

Manufacturing parts using powder metal technology typically involves the steps of (1) placing a metal powder composition into a mold, (2) compressing the metal powder in the mold into the shape of the desired part under a pressure of 20 tons per square inch to 70 tons per square to make a preformed part (green metal part), (3) removing the green metal part from the mold, and (4) sintering the green metal part at an elevated temperature which is typically within the range of about 60% to about 90% of the melting point of the metal composition to produce the sintered metal part. The sintering temperature will normally be in the range of 1830° F. (1000° C.) to 2450° F. (1343° C.). After being sintered metal part can be further worked if necessary or desirable to make the finished metal part.

In a wide variety of applications there is a need for powder metal parts that have improved acoustical dampening properties without compromising the physical performance characteristics of the part. In other words, the strength, durability, wear characteristics, service life, and uniform of the part should not be sacrificed to attain a part that generates less noise during operation. For instance, it is important for acoustical dampening gears that are used in automotive applications, consumer products, and a wide variety of other applications to maintain their requisite performance characteristics while providing for quieter operation. There has been a long felt, but unfulfilled need, for such high quality, acoustical dampening parts made utilizing powder metal technology. However, such parts that offer high strength, good durability, good wear characteristics, and a long service life which can be made to a high level of tolerance and with good uniformity have proven to be elusive.

SUMMARY OF THE INVENTION

This invention is based upon the unexpected discovery that the sound dampening characteristic of powder metal parts can be dramatically improved by incorporating coarse graphite into the part. This acoustic attenuating characteristic is of value in countless parts where it is desirable for the part to generate less noise during operation. It is, of course, of greatest value in parts which move or rotate during normal use in a manner that generates noise, such as gears (including gears for rotary gear pumps), rotors and sprockets. Surprisingly, the incorporation of the coarse graphite into such parts does not significantly compromise the strength, durability, wear characteristics, or service life of the part. Such parts can also be manufactured to a high level of tolerance and with good uniformity utilizing powder metal technology.

The present invention more specifically discloses a powder metal part which is comprised of a sintered powder metal composition, wherein the powder metal composition includes 0.1 weight percent to 5 weight percent of a coarse graphite, wherein the coarse graphite is of a particle size wherein at least at least 30 percent of the coarse graphite will not pass through a 325 mesh screen.

BRIEF DESCRIPTION OF THE DRAWING

FIG. 1 is a perspective view of a helical gear that can be manufactured utilizing course graphite in accordance with this invention.

DETAILED DESCRIPTION OF THE INVENTION

The acoustic attenuating parts of this invention can be made using conventional procedures for manufacturing powder metal parts. However, the powder metal composition utilized in making the part will include 0.1 weight percent to 5 weight percent of coarse graphite. In such a procedure normally includes the steps of (1) placing a metal powder composition into a mold having the desired shape of the part, (2) compressing the metal powder in the mold into the shape of the part under a pressure of 20 tons per square inch to 70 tons per square inch to produce a green metal part, (3) removing the green metal part from the mold, and (4) sintering the green metal part at an elevated temperature which is typically within the range of about 60% to about 90% of the melting point of the metal composition to produce the sintered metal part.

In manufacturing the powder metal parts of this invention a mold of the desired shape is filled with a powder metal composition. After the metal powder formulation is introduced into the mold the powder is compressed under high pressure, typically from 20 to 70 tons per inch$^2$ (tsi) and more typically 40 to 65 tons per inch$^2$ (tsi). This compressed part or preform is then considered to be green or uncured. The green part is then cured or sintered by heating in a sintering furnace, such as an electric or gas-fired belt or batch sintering furnace, for a predetermined time at high temperature in an inert environment or reducing atmosphere. Nitrogen, vacuum and Noble gases, such as helium or argon, are examples of such inert protective environments. Metal powders can be sintered in the solid state with bonding by diffusion rather than melting and re-solidification. Also, sintering may result in a decrease in density depending on the composition and sintering temperature. For instance, chromium containing compositions typically maintain or decrease in density while nickel containing compositions generally increase in density.

Typically, the sintering temperature utilized will be about 60% to about 90% of the melting point of the metal composition being employed. The sintering temperature will normally be in the range of 1830° F. (1000° C.) to 2450° F. (1343° C.). The sintering temperature will more typically be within the range of 2000° F. (1093° C.) to about 2400° F. (1316° C.). In any case, the appropriate sintering temperature and time-at-temperature will depend on several factors, including the exact chemistry of the metallurgical powder, the size and geometry of the compact, and the heating equipment used. Those of ordinary skill in the art may readily determine appropriate parameters for the molding steps to provide a green preform of suitable density and geometry which is then placed into a furnace at temperature which is within the range of 2000° F. (1093° C.) to 2450° F. (1343° C.) for approximately 30 minutes in a protective atmosphere to sinter the metal.

The final density of the part will vary widely depending on its composition and the particular pressing and sintering parameters employed. The density of the final part will normally be within the range of 6.6 g/cc to 7.5 g/cc. The final part will typically have a density which is within the range of 6.7 g/cc to 7.4 g/cc and will commonly have a density which is within the range of 6.9 g/cc to 7.3 g/cc.

The metal powders that can be utilized in manufacturing powder metal parts are typically a substantially homogenous powder including a single prealloyed alloyed or unalloyed metal powder or a blend of one or more such powders and, optionally, other metallurgical and non-metallurgical additives such as, for example, lubricants. In any case, the metal powder composition used in the practice of this invention will contain 0.1 weight percent to 5 weight percent of coarse graphite.

The powder metal composition will generally contain from 0.2 weight percent to 4 weight percent of the coarse graphite and metal composition will more generally contain from 0.5 weight percent to 3 weight percent of the coarse graphite. It is normally preferred for the coarse graphite to be present in the metal composition at a level which is within the range of 0.75 weight percent to 2 weight percent with it being more preferred for the coarse graphite to be present in the metal composition at a level which is within the range of 1 weight percent to 1.5 weight percent.

The coarse graphite used in the practice of this invention has a particle size wherein at least at least 30 percent of the coarse graphite will not pass through a 325 mesh screen and where preferably at least 35 percent of the coarse graphite will not pass through a 325 mesh screen. The coarse graphite also typically has an average particle size which is within the range of 35 microns to 55 microns and has a surface area which is within the range of 2.9 $m^2/g$ to 3.5 $m^2/g$. In many cases the coarse graphite will have a surface area which is within the range of 3.0 $m^2/g$ to 3.3 $m^2/g$ and a Scott volume which is within the range of 4.5 g/in 3 to 5.0 $g/in^3$. Coarse graphite which is suitable for use in the practice of this invention may have a Scott volume which is within the range of 4.6 g/in 3 to 4.8 $g/in^3$.

The base metal powders to which the coarse graphite is added in manufacturing powder metal parts in accordance with this invention are typically a substantially homogenous powder including a single alloyed or unalloyed metal powder or a blend of one or more such powders and, optionally, other metallurgical and non-metallurgical additives such as, for example, lubricants. Thus, "metallurgical powder" may refer to a single powder or to a powder blend. There are three conventional types of base metal powders used to make powder metal mixes and parts. The most common base metal powders are homogeneous elemental powders such as iron, copper, nickel and molybdenum. These are blended together, along with additives such as lubricants and the coarse graphite, and molded as a mixture. A second possibility is to use pre-alloyed powders, such as an iron-nickel-molybdenum steel. In this case, the alloy is formed in the melt prior to atomization and each powder particle is a small ingot having the same composition as the melt. Again, additives of the coarse graphite, lubricant and elemental powders may be added to make the mix. A third type is known as "diffusion bonded" powders. In this case, an elemental powder, such as iron, is mixed with a second elemental powder or oxide of a powder, and is subsequently sintered at low temperatures so partial diffusion of the powders occurs. This yields a powder with fairly good compressibility which shows little tendency to separate during processing. While iron is the most common metal powder, powders of other metals such as aluminum, copper, tungsten, molybdenum and the like may also be used. Also, as used herein, an "iron metal powder" is a powder in which the total weight of iron and iron alloy powder is at least 50 percent of the powder's total weight. While more than 50% of the part's composition is iron, the powder may include other elements such as carbon, sulfur, phosphorus, manganese, molybdenum, silicon, and chromium. Copper and nickel can also optionally be present in pre-alloyed base metal powder compositions. Typically, the base metal powder will contain at least 95 weight percent iron and will preferably contain at least 97 weight percent iron.

At least four types of metallic iron powders are available. Electrolytic iron, sponge iron, carbonyl iron and nanoparticle sized iron are made by a number of processes. Electrolytic iron is made via the electrolysis of iron oxide, and is available in annealed and unannealed form from, for example, OM Group, Inc., which is now owned by North American Hoganas, Inc. Sponge iron is also available from North American Hoganas, Inc. There are at least two types of sponge iron: hydrogen-reduced sponge iron and carbon monoxide-reduced sponge iron. Carbonyl iron powder is commercially available from Reade Advanced Materials. It is manufactured using a carbonyl decomposition process.

Depending upon the type of iron selected, the particles may vary widely in purity, surface area, and particle shape. The following non-limiting examples of typical characteristics are included herein to exemplify the variation that may be encountered. Electrolytic iron is known for its high purity and high surface area. The particles are dendritic. Carbonyl iron particles are substantially uniform spheres, and may have a purity of up to about 99.5 percent. Carbon monoxide-reduced sponge iron typically has a surface area of about 95 square meters per kilogram ($m^2/kg$), while hydrogen-reduced sponge iron typically has a surface area of about 200 $m^2/kg$. Sponge iron may contain small amounts of other elements, for example, carbon, sulfur, phosphorus, silicon, magnesium, aluminum, titanium, vanadium, manganese, calcium, zinc, nickel, cobalt, chromium, and copper. Other additives in addition to the coarse graphite may also be used in molding the green part.

After being sintered, the part can be subjected to additional processing steps as needed to attain desired characteristics. For instance, the sintered part can optionally be further processed by (1) densifying the surface of the sintered metal part by shot-peening to produce a densified metal part, (2) machining the densified metal part to improve the dimensional accuracy, (3) compacting the surface of the part with a diamond coated arbor to further densify the surface of the part, (4) slurry finishing the densified metal part to remove surface burrs, (5) carburizing the sintered metal part to produce a carburized metal part, (6) tempering the metal part at an elevated temperature which is sufficient to stress relieve the part to produce a tempered metal part, (7) tempering, (8) grinding the surface of the part to smooth its surface, (9) tape polishing the surface of the part to further improve the surface finish of the part, (10) washing to clean the surface of the metal part, and/or (11) rinsing the metal part with a rust inhibitor.

This invention is of benefit in manufacturing a wide variety of powder metal parts which generate noise during use, such as gears, rotors, sprockets, and transmission overdrive hubs. For instance, it is of benefit in reducing the level of noise generated by all types of gears having external and/or internal gear profiles, including spur gears, helical gears, double helical gears, bevel gears, skew gears, hypoid gears, worm gears, and the like. Spur gears, which are also known as straight-cut gears, consist of a cylinder or disk having teeth which project radially therefrom with the edge of each tooth being straight and aligned parallel to the axis of rotation of the gear. The teeth of spur gears typically have an involute or cycloidal design to achieve a constant drive ratio. Spur gears are simple, relatively easy to manufacture, and are excellent for use in applications where they are used a slow to moderate speeds. However, spur gears are notorious for being noisy in high speed applications. Accordingly, spur gears made in accordance with this invention generate significantly less noise when operated at high speeds (when the pitch line velocity is greater than about 25 m/s).

In helical gears the leading edges of the teeth are set at an angle rather than being parallel to the axis of rotation as they are in spur gears. Since the gear is curved, this angling makes the tooth shape a segment of a helix. Helical gears generate less noise at high speed than do spur gears. However, the level of noise generated by helical gears can also be significantly reduced if manufactured in accordance with this invention. FIG. 1 is an illustration of a helical gear 1 that can be manufactured in accordance with this invention. As can be seen, this gear includes such an external component 2 and an internal component 3. As can be seen, the external component 2 includes gear teeth 5 which are situated on the outer radial surface of the gear 1. In one embodiment of this invention the external component 2 of the gear includes course graphite with the internal component 3 being made without including course graphite. In any case, the internal component 3 can be molded so as to have an internal profile of any desired shape, such as a gear face or a hexagon shaped hole, or in the case of the gear illustrated in FIG. 1 a circular shaped hole 4.

One disadvantage associated with helical gears is that they generate thrust along the axis of the gear which typically must be compensated for by the use of thrust bearings. The problem associated with axial thrust is eliminated by herringbone gears or double helical gears wherein axial thrust is canceled by the geometry of the gear. In any case, the benefit of reduced noise generation can also be achieved in double helical gears and multi-helical gears by incorporating course graphite into the gear. Such herringbone gears and techniques for manufacturing them are described in greater detail in U.S. Pat. Nos. 7,364,803 and 7,854,995. The teachings of U.S. Pat. Nos. 7,364,803 and 7,854,995 are incorporated herein by reference for the purpose of describing double helical gears and multi-helical gears and methods that can be used in manufacturing such gears.

This invention is illustrated by the following examples that are merely for the purpose of illustration and are not to be regarded as limiting the scope of the invention or the manner in which it can be practiced. Unless specifically indicated otherwise, parts and percentages are given by weight and the Mesh size given were determined using U.S. Standard test sieves.

Examples 1-5

In this series of experiments 1 inch thick sintered powder metal test pieces having the compositions delineated in Table 1 were tested for acoustic attenuation characteristics at 3.5 MHZ. Acoustic attenuation was calculated by measuring the amplitude of the ultrasonic signal propagated through the 1 inch thick test pieces and is reported in Table 1. All acoustic attenuation ratios were normalized to the standard production composition of Example 1 (control piece).

TABLE 1

| | 1 | 2 | 3 | 4 | 5 |
|---|---|---|---|---|---|
| % Iron | 97.25 | 95.5 | 95.5 | 98.35 | 96.65 |
| % Nickel | 2.0 | 2.0 | 0.0 | 0.0 | 0.0 |
| % Molybdenum | 0.0 | 0.0 | 0.0 | 0.85 | 0.85 |
| % Copper | 0.0 | 0.0 | 2.0 | 0.0 | 0.0 |
| % Standard graphite* | 0.75 | 0.75 | 0.75 | 0.8 | 0.8 |
| % Coarse graphite** | 0.0 | 1.75 | 1.75 | 0.0 | 1.7 |
| Acoustic Attenuation Ratio | 1.0 | 9.6 | 6.2 | 7.4 | 35.2 |

*Standard 1651 graphite having a D50 particle size distribution of 11.2 μm and a D90 particle size distribution of 17.7 μm.
**The coarse graphite was obtained from Asbury Graphite Mills, Inc. of Kittanning, Pennsylvania with a typical analysis being reported as:
99.5% carbon
0.2% +100 Mesh (150 Micron)
12% +200 Mesh (75 Micron)
26.4% +325 Mesh (44 Micron)
61.4% −325 Mesh (44 Micron)
4.75 g/in$^3$ Scott Volume
3.15 m$^2$/g Surface Area The higher the Acoustic Attenuation Ratio is the better the material is for acoustic attenuation which translates into a quieter running part. As can be seen, the inclusion of the coarse graphite in the powder metal part dramatically improved acoustic attenuation characteristics. The inclusion of 1.75% of the coarse graphite in Example 2 greatly improved sound deadening characteristics over the nickel containing metal composition of Example 1 which was run as a control. The greatest improvement was found in the metal compositions that contained molybdenum with the acoustic attenuation improvement of Example 5 being greatly improved over that determined in Example 4 which was run as a control. Accordingly, compositions that contain 0.4% to 2% molybdenum and 1.0% to 4% coarse graphite (with the balance of the composition being iron) have excellent acoustic attenuation characteristics. Such molybdenum containing compositions will normally also contain 0.2% to 2% of standard graphite. It is typically preferred for such compositions to contain 0.6% to 1.1% molybdenum and 1.5% to 2% coarse graphite (with the balance of the composition being iron). Such molybdenum containing compositions will normally also contain 0.5% to 1% of standard graphite. The standard graphite will normally have a D50 particle size distribution which is within the range of 8 μm to 14 μm, will more typically have a D50 particle size distribution which is within the range of 9 μm to 13 μm, and will most typically have a D50 particle size distribution which is within the range of 10 μm to 12 μm. The standard graphite will also normally have a D90 particle size distribution which is within the range of 15 μm to 21 μm, will more typically have a D90 particle size distribution which is within the range of 16 μm to 20 μm. and will most typically have a D90 particle size distribution which is within the range of 17 μm to 18 μm. D50 particle size is the size at which 50% of the mass of the graphite particles are smaller and 50% of the mass of the graphite particles are larger. D90 particle size is the size at which 90% of the mass of the graphite particles are smaller and 10% of the mass of the graphite particles are larger.

While certain representative embodiments and details have been shown for the purpose of illustrating the subject invention, it will be apparent to those skilled in this art that various changes and modifications can be made therein without departing from the scope of the subject invention.

What is claimed is:

1. A powder metal part which consists of a sintered powder metal composition, wherein the powder metal composition consists of a coarse graphite wherein the coarse graphite is present at a level which is within the range of 1 weight percent to 5 weight percent, optionally nickel, optionally molybdenum, optionally copper, optionally phosphorus, optionally magnesium, optionally silicon, optionally chromium, optionally aluminum, optionally titanium, optionally vanadium, optionally calcium, optionally zinc, and optionally cobalt, and optionally 0.02 to 2% of a standard graphite having a D50 particle size distribution which is within the range of 8 μm to 14 μm and a D90 particle size distribution which is within the range of 15 μm to 21 μm, with the balance of the powder metal composition being iron, wherein the coarse graphite is of a particle size wherein at least 30 percent of the coarse graphite will not pass through a 325 mesh screen, and wherein the powder metal part is a gear.

2. The powder metal part of claim 1 wherein the powder metal part is a pump gear.

3. The powder metal part of claim 1 wherein the powder metal part is a transmission gear.

4. The powder metal part of claim 1 wherein the gear is a helical gear.

5. The powder metal part of claim 4 wherein the helical gear is a herringbone gear.

6. The powder metal part of claim 1 wherein the part has a density which is within the range of 6.6 g/cc to 7.5 g/cc.

7. The powder metal part of claim 1 wherein the part has a density which is within the range of 6.9 g/cc to 7.3 g/cc.

8. The powder metal part of claim 1 wherein the powder metal composition contains the 0.02 to 2% of a standard graphite having a D50 particle size distribution which is within the range of 8 μm to 14 μm and a D90 particle size distribution which is within the range of 15 μm to 21 μm, and wherein molybdenum is present in the powder metal composition at a level which is within the range of 0.4% to 2%.

9. The powder metal part of claim 8 wherein the powder metal composition consists of the iron, the molybdenum, the coarse graphite powder, and the standard graphite, and wherein the coarse graphite is present in the powder metal composition at a level which is within the range of 1.25 weight percent to 3 weight percent.

10. The powder metal part of claim 1 wherein the coarse graphite is present in the powder metal composition at a level which is within the range of 1.5 weight percent to 2 weight percent.

11. The powder metal part of claim 1 wherein the coarse graphite is of a particle size wherein at least 35 percent of the coarse graphite will not pass through a 325 mesh screen.

12. The powder metal part of claim 1 wherein the coarse graphite is of a surface area which is within the range of 2.9 $m^2/g$ to 3.5 $m^2/g$.

13. The powder metal part of claim 1 wherein the coarse graphite is of a surface area which is within the range of 3.0 $m^2/g$ to 3.3 $m^2/g$.

14. The powder metal part of claim 1 wherein the coarse graphite has an average particle size which is within the range of 35 microns to 55 microns.

15. The powder metal part of claim 1 wherein the coarse graphite has a Scott Volume which is within the range of 4.5 g/in 3 to 5.0 $g/in^3$.

16. The powder metal part of claim 1 wherein the coarse graphite has a Scott Volume which is within the range of 4.6 g/in 3 to 4.9 $g/in^3$.

17. The powder metal part of claim 1 wherein the metal composition contains 0.4% to 2% molybdenum and 1.0% to 4% coarse graphite with the balance of the composition being iron.

18. A powder metal part which consists of a sintered powder metal composition, wherein the powder metal composition consists of a coarse graphite wherein the coarse graphite is present at a level which is within the range of 1 weight percent to 5 weight percent, optionally nickel, optionally molybdenum, optionally phosphorus, optionally magnesium, optionally silicon, and optionally chromium, with the balance of the powder metal composition being iron, wherein the coarse graphite is of a particle size wherein at least 30 percent of the coarse graphite will not pass through a 325 mesh screen, and wherein the powder metal part is a gear.

19. The powder metal part of claim 18 wherein the metal composition contains 0.6% to 1.1% molybdenum, 1.5% to 2% coarse graphite, and 0.5% to 1% standard graphite with the balance of the composition being iron, wherein the standard graphite has a D50 particle size distribution which is within the range of 8 μm to 14 μm and a D90 particle size distribution which is within the range of 15 μm to 21 μm.

* * * * *